US008911032B2

(12) United States Patent
Noel et al.

(10) Patent No.: US 8,911,032 B2
(45) Date of Patent: Dec. 16, 2014

(54) RETAIL PRODUCT DISPLAY SYSTEM WITH A DRAWER PROVIDED WITH A MOVABLE DEMONSTRATION PRODUCT LOCATOR AT ITS FRONT

(75) Inventors: Harold Noel, Argentieres (FR); Fabien Brossard, Paris (FR); Patrick Ple-Boishardy, Paris (FR)

(73) Assignee: ELC Management LLC, New York, NY (US)

( * ) Notice: Subject to any disclaimer, the term of this patent is extended or adjusted under 35 U.S.C. 154(b) by 109 days.

(21) Appl. No.: 13/395,524

(22) PCT Filed: Sep. 17, 2010

(86) PCT No.: PCT/EP2010/063716
§ 371 (c)(1),
(2), (4) Date: Jul. 26, 2012

(87) PCT Pub. No.: WO2011/042289
PCT Pub. Date: Apr. 14, 2011

(65) Prior Publication Data

US 2012/0280600 A1 Nov. 8, 2012

(30) Foreign Application Priority Data

Oct. 9, 2009 (EP) ..... 09290770

(51) Int. Cl.
*A47F 3/00* (2006.01)
*A47F 7/28* (2006.01)

(52) U.S. Cl.
CPC ..... *A47F 7/286* (2013.01)
USPC ..... 312/139.1

(58) Field of Classification Search
USPC ..... 312/114, 138.1, 139, 139.1, 270.2, 312/270.3, 301–311, 313, 322–323
See application file for complete search history.

(56) References Cited

U.S. PATENT DOCUMENTS

| | | | | |
|---|---|---|---|---|
| 1,949,827 | A * | 3/1934 | Conwell | 312/313 |
| 1,990,980 | A * | 2/1935 | Fakkema | 312/323 |
| 2,006,603 | A * | 7/1935 | Merrill et al. | 108/32 |
| 4,168,871 | A * | 9/1979 | Dierkes | 312/324 |

(Continued)

FOREIGN PATENT DOCUMENTS

| | | |
|---|---|---|
| CN | 1870921 | 11/2006 |
| DE | 9214414 U1 | 12/1992 |

(Continued)

OTHER PUBLICATIONS

PCT Int'l Search Report; Int'l Applic. No. PCT/EP2010/063716; Completion Date: Dec. 15, 2010; Date of Mailing: Dec. 22, 2010.

(Continued)

*Primary Examiner* — Matthew Ing
(74) *Attorney, Agent, or Firm* — Martin W. Haerter

(57) ABSTRACT

A retail product display system has a retail product drawer slideable between a closed position and an open position. A demonstration product locator is arranged at the front of the retail product drawer and is movable between two extreme positions respectively, an inclined display position and a horizontal display position. The system is arranged for allowing the demonstration product locator to be in the inclined display position when the retail product drawer is in the closed position and for allowing the demonstration product locator to be in the horizontal display position when the retail product drawer is in the open position.

11 Claims, 5 Drawing Sheets

(56) References Cited

U.S. PATENT DOCUMENTS

| | | | | |
|---|---|---|---|---|
| 5,215,364 | A * | 6/1993 | Moore | 312/323 |
| 5,800,029 | A * | 9/1998 | Robertson et al. | 312/271 |
| 6,203,087 | B1 * | 3/2001 | Lance et al. | 296/37.6 |
| 6,474,760 | B2 * | 11/2002 | Rauls | 312/330.1 |
| 7,963,408 | B2 * | 6/2011 | Glover | 211/126.15 |
| 2005/0126858 | A1 * | 6/2005 | Yingst et al. | 186/38 |
| 2007/0062891 | A1 * | 3/2007 | Stievenard | 211/59.2 |

FOREIGN PATENT DOCUMENTS

| | | |
|---|---|---|
| EP | 0997091 | 5/2000 |
| EP | 1481619 | 12/2004 |
| EP | 1688070 | 8/2006 |
| GB | 2018225 | 10/1979 |
| JP | 9-003934 Y | 4/1934 |
| JP | S55-14075 | 1/1980 |
| JP | 6-081360 U | 11/1994 |
| JP | 2005-118112 | 5/2005 |
| JP | 2007-508884 | 4/2007 |
| JP | 2008-307278 | 12/2008 |

OTHER PUBLICATIONS

PCT Written Opinion of the Int'l Searching Authority; Int'l Applic. No. PCT/EP2010/063716; Completion Date: Dec. 15, 2010; Mailing Date: Dec. 22, 2010.

Supplementary European Search Report; EP09290770; Completion Date: Mar. 18, 2010; Date of Mailing: Mar. 31, 2010.

* cited by examiner

RETAIL PRODUCT DISPLAY SYSTEM WITH A DRAWER PROVIDED WITH A MOVABLE DEMONSTRATION PRODUCT LOCATOR AT ITS FRONT

This application is a national stage filing of PCT/EP2010/063716, filed Sep. 17, 2010, which claims priority of EP 09290770.8, filed Oct. 9, 2009, herein incorporated by reference, in its entirety.

FIELD OF THE INVENTION

The invention relates to a retail product display system adapted for receiving retail products for sale and for displaying demonstration products possibly along with information about the retail products. The invention also relates to a retail product display stand comprising one or more of such retail product display systems. The invention further relates to the use of the retail product display system or stand of the invention for selling or promoting retail cosmetic products.

BACKGROUND OF THE INVENTION

Retail product display systems are well known in the art. Some of them consist in a demonstration product track for receiving demonstration products. The demonstration product track is secured on a shelf by one edge of the track. Retail products corresponding to the demonstration products placed on the demonstration product track are placed behind the demonstration product track for sale. In a retail shop, a customer in front of the retail product system is able in the same position to use the demonstration product or to take the retail product to purchase. Such a display system is disclosed e.g. in EP-A-0 997 091.

The size of the demonstration product track is preferably chosen as great as possible for displaying many demonstration products and related information for customer. However when the size of the demonstration track is increased to a too great extent, customers experience difficulties in passing their hand behind the demonstration product track to take retail products for sale as the space left between the demonstration product track and the one of the shelf just above is reduced.

An improvement consisted in arranging a shelf slidingly movable like a drawer, the demonstration product track being mounted on the edge of the shelf as before. EP-A-1 481 619 is an example of such a retail product display system. The customer can pull the shelf out by pulling at the demonstration product track in order to have easier access to the retail products on the shelf behind the demonstration product track. Such a system still has drawbacks. In particular the access of the customer is still impeded by the demonstration product track which extends to a high level with respect to the retail products for sale placed behind it. Further, the shelves get dirty quickly due to the dust that deposit on them, thus the display being less attractive to the customers especially when not much retail products are placed on them.

SUMMARY OF THE INVENTION

The object of the present invention is to alleviate at least partly the above mentioned drawbacks.

More particularly, the invention aims to offer a greater space for accommodating demonstration products or displaying information with an easy access to the retail product for purchase by the customers.

This object is achieved with a retail product display system, comprising:

a retail product drawer slideable between a closed position and an open position;

a demonstration product locator arranged at the front of the retail product drawer and movable between two extreme positions respectively an inclined display position and a horizontal display position;

wherein the system is arranged for allowing the demonstration product locator to be in the inclined display position when the retail product drawer is in the closed position and for allowing the demonstration product locator to be in the horizontal display position when the retail product drawer is in the open position.

Preferred embodiments are defined in the dependent claims. The invention further proposes a retail product display stand comprising at least one such retail product display system. The retail product display stand as well as the retail product display system according to the invention are particularly well adapted to be used for selling or promoting retail cosmetic products.

Further features and advantages of the invention will appear from the following description of embodiments of the invention, given as non-limiting examples, with reference to the accompanying drawings listed hereunder.

DETAILED DESCRIPTION OF THE INVENTION

The invention proposes a retail product display system, comprising a retail product drawer slideable between a closed position and an open position. The retail product display system further comprises a demonstration product locator arranged at the front of the retail product drawer. The demonstration product locator is movable between two extreme positions respectively an inclined display position and a horizontal display position. The retail product display system is arranged for allowing the demonstration product locator to be in the inclined display position when the drawer is in the closed position. The retail product display system is further arranged for allowing the demonstration product locator to be in the horizontal display position when the drawer is in the open position. The combination of these different features allows the retail product display system to have at least two configurations corresponding to the two extreme positions of the demonstration product locator.

Figure 1:
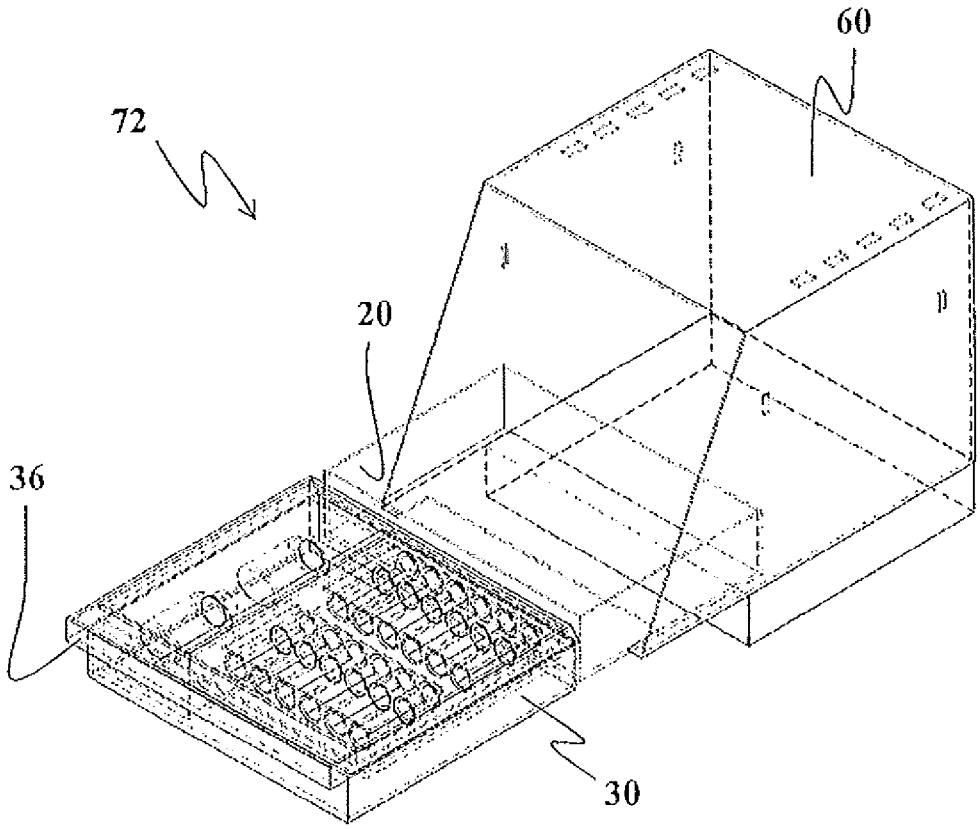
FIG. 1 shows a transparent perspective view of a retail product display system according to a preferred embodiment of the invention, the retail product drawer being in the open position.

In the first configuration, as illustrated in FIG. 1, the retail product drawer 20 is open and the demonstration product locator 30 is in the horizontal display position. In this configuration a customer can easily access retail products disposed in the retail product drawer 20 (not represented) for sale. Indeed the retail product drawer 20 is entirely open and the demonstration product locator 30 does not impede the hand of the customer taking the retail products.

Figure 3:
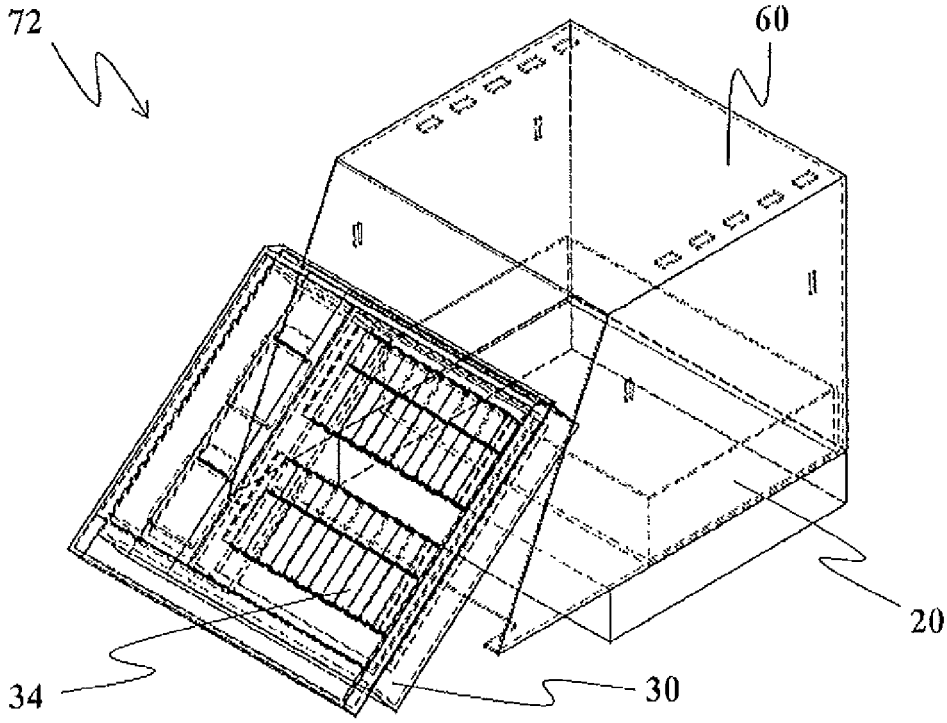
FIG. 3 shows a transparent perspective view of the retail product display system of FIG. 1, with the demonstration product locator in an intermediate position between the horizontal position and the inclined display position.

The FIG. 3 shows an intermediary view during the motion of the retail product display system 72 between the first configuration and the second configuration. The demonstration product locator 30 is in an intermediate position between the horizontal position and the inclined display position.

Figure 4:
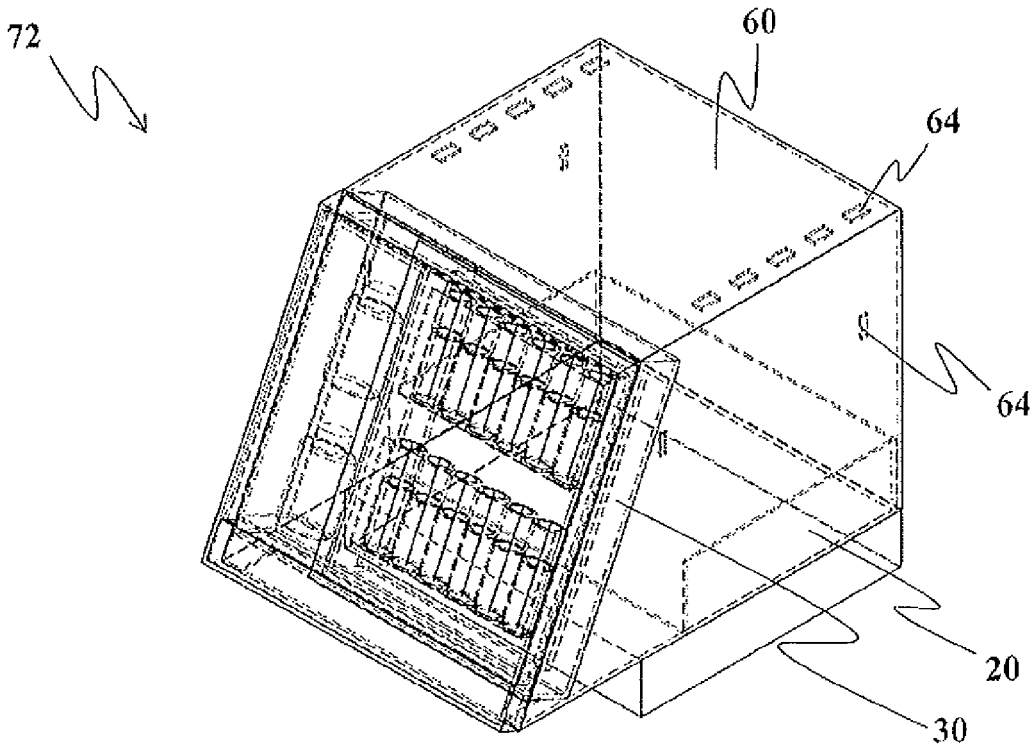
FIG. 4 shows a transparent perspective view of the retail product display system of FIG. 1, with the demonstration product locator in the inclined display position.

In the second configuration, as illustrated in FIG. 4, the retail product drawer 20 is closed and the demonstration product locator 30 is in the inclined display position. As can be seen, the demonstration product locator is of great size and thus makes it possible to display a great number of demonstration products if wished as well as information for the customer which could be viewed from a great distance if wished.

The first configuration, with the demonstration product locator 30 in the horizontal display position, also fulfills a displaying function. The demonstration product locator 30 in the horizontal display position with its demonstration products 34 and its information for the customer, is visible from above for the customer in the vicinity of the retail product display system 72. In other words, demonstration products and the information born by the demonstration product locator 30 are still visible to the customer e.g. when taking retail products for sale in the retail product drawer 20.

Consequently the retail product display system achieves the aim of offering a greater space for accommodating demonstration products or displaying information with an easy access to the retail product for purchase by the customer.

With reference to FIG. 4, the retail product display system 72 in the second configuration prevents the customer from accessing the content of the retail product drawer 20. Indeed when the demonstration product locator 30 is in the inclined display position, no space is provided for the customer to access the retail product drawer 20. In the condition of use of the retail product display system 72, e.g. in a display store, the front space of the retail product display system 72—which faces the customer—is occupied by the demonstration product locator 30 in the inclined display position. Communication with the customer by means of the demonstration product locator 30 is thus maximized.

Unlike the second configuration which prevents the customer accessing the content of the retail product drawer 20, the first configuration allows the customer to easily access the content of the retail product drawer 20. The demonstration product locator 30 is in the horizontal display position. As shown in FIG. 1, the demonstration product locator 30 is aligned in front of the retail product drawer 20. In this configuration, no element prevents or hinders the customer to access the retail products 34 in the retail product drawer 20.

The retail product display system 72 comprises a box for housing the retail product drawer 20 in the closed position. With reference to FIG. 4, the demonstration product locator 30 can be arranged for closing the box when the retail product drawer 20 is in the closed position and the demonstration product locator 30 is in the inclined display position. The box 60 and the demonstration product locator 30 then form a closed box encompassing the retail product drawer 20. The retail product drawer 20 is completely hidden from the sight of the customer when the demonstration product locator 30 is in the inclined display position. The hiding of the retail product drawer 20—which might be empty if all retail products were already taken out—allow to catch the interest of the customer for the demonstration products 34 irrespectively of whether retail products are available or not in the retail product drawer. Further, if the space for receiving the retail products in the retail product drawer is not wholly filled with retailed products and is somewhat dirty, customers will not see it and thus the attractiveness of the retail product display system will not be impeded.

Further the encompassing of the retail product drawer 20 in a closed box prevents dust from deposing on the retail products or in the retail product drawer 20 which would be again spoil the attractiveness of the retail product display system.

The retail product display system also comprises a mechanism that moves the demonstration product locator 30 to the inclined display position when the retail product drawer 20 is moved into the closed position. Further the mechanism moves the demonstration locator 30 to the horizontal display position when the retail product drawer 20 is moved into the open position.

Figure 5:
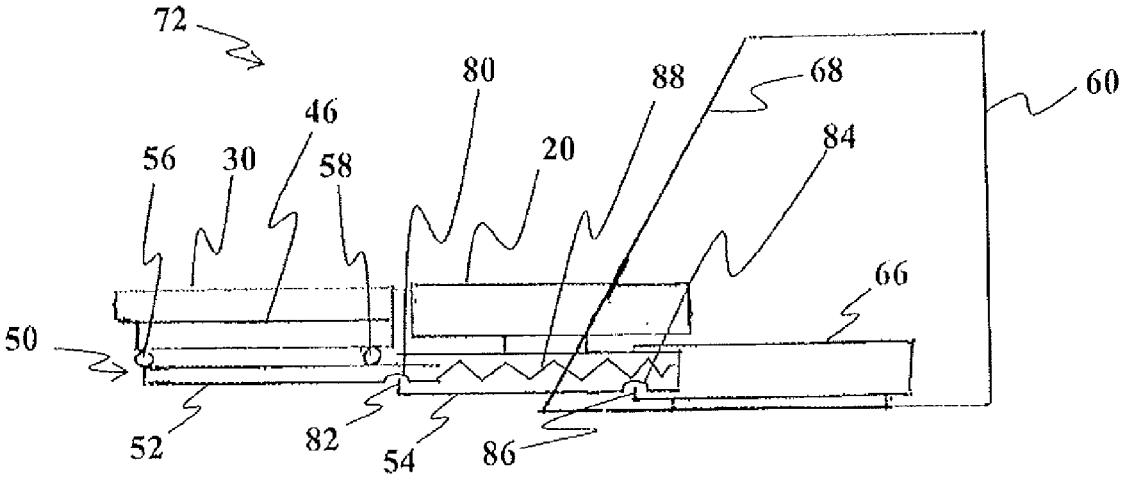
FIG. 5 is a diagram of the mechanism with the demonstration product locator in the horizontal display position and with the retail product drawer open.

With reference to FIG. 5, the mechanism 50 may comprise telescopic tubes 52, 54, 66, a hinge 56, an abutment 58, a ramp 68 and a shoulder 46. The telescopic tube 66 is a fixed part of the retail product display system 72. The other telescopic tubes 52, 54 are slidably mounted one into the other and into the telescopic tube 66. The demonstration product locator 30 is pivotally mounted to the front end of the telescopic tube 52 by a hinge 56. Further the demonstration product locator 30 comprises the abutment 58 to come up against the rear end of the telescopic tube 52, when the demonstration product locator 30 is in the horizontal display position. The retail product drawer 20 is mounted on the telescopic tube 54. The ramp 68 is provided, for example on the box 60, to guide the shoulder 46 of the demonstration product locator 30, thereby guiding the demonstration product locator 30 to the inclined display position.

Figure 2:
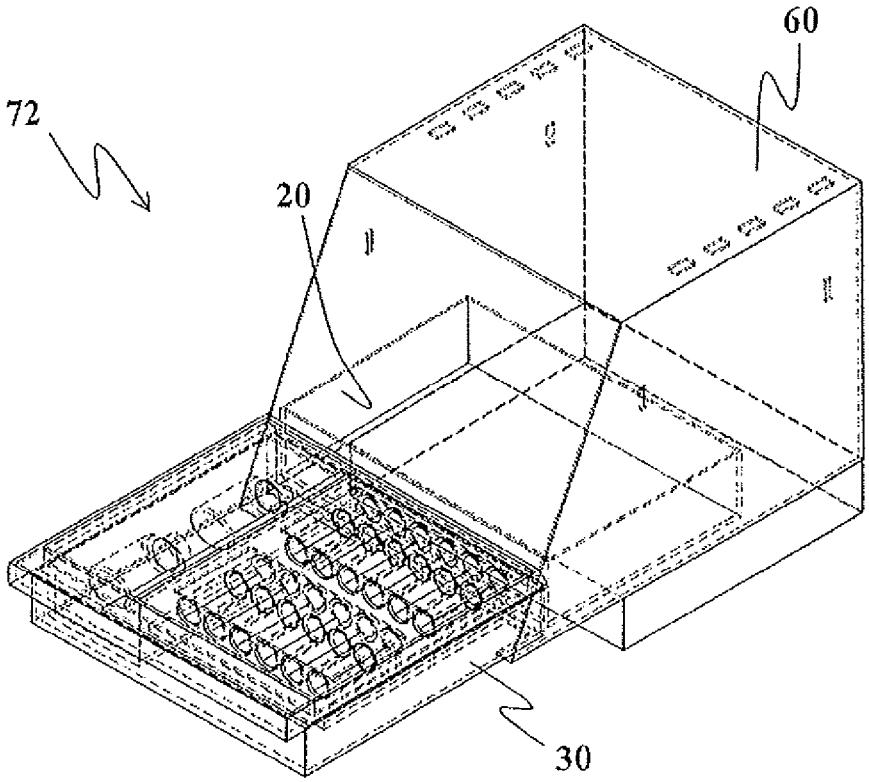
FIG. 2 shows a transparent perspective view of the retail product display system of FIG. 1, with the demonstration product locator in the horizontal display position.
Figure 6:
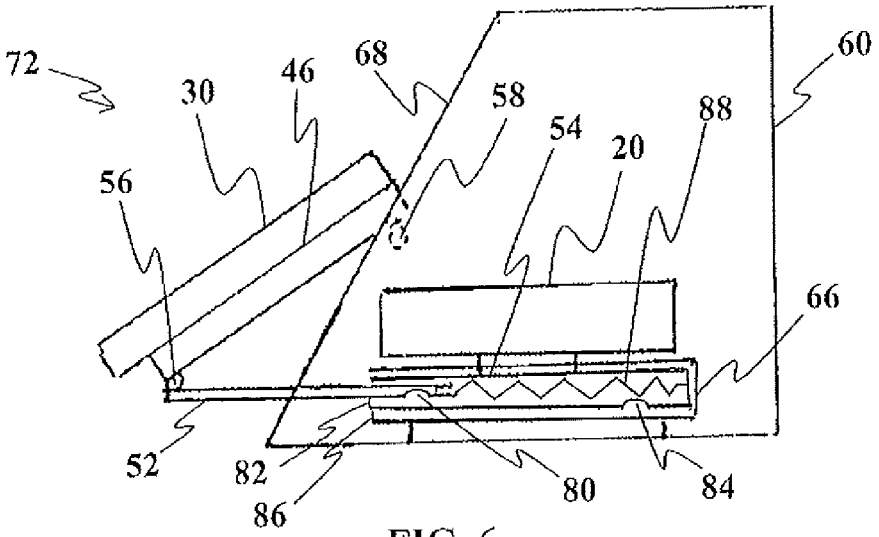
FIG. 6 is a diagram of the mechanism with the demonstration product locator in an intermediate position and with the retail product drawer closed.

Thus, the movement of the demonstration product locator 30 from the horizontal display position to the inclined display position is linked to the closing movement of the retail product drawer 20 as represented in FIGS. 5 and 6. By pushing the demonstration product locator 30, the telescopic tube 54 slides in the telescopic tube 66, thereby closing the retail product drawer 20 as represented in FIG. 2.

Pushing the demonstration product locator 30 causes its shoulder 46 to contact the ramp 68. Further pushing the demonstration product locator 30 causes the rear part of the shoulder 46 to slide on the ramp 68 thereby rotating the demonstration product locator 30 about hinge 56. The demonstration product locator 30 is then in an intermediate position, as represented in FIG. 6.

By further pushing the demonstration product locator 30, the front part of shoulder 46 abuts on the ramp 68 and thus the demonstration product locator 30 stops sliding on the ramp 68 and rotating about hinge 56. The demonstration product locator 30 is then in the inclined display position, as shown in FIG. 7.

Figure 7:
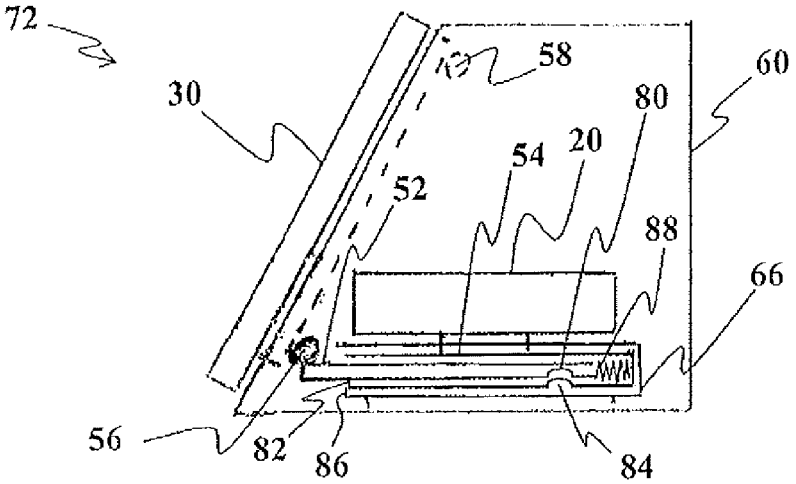
FIG. 7 is a diagram of the mechanism with the demonstration product locator in the inclined display position and with the retail product drawer closed.

The movement from the inclined display position to the horizontal display position of the demonstration product locator 30 is shown in FIGS. 5 to 7, but seen in the reverse order. In other words, the demonstration product locator 30 is moved from the inclined display position to the horizontal display position by pulling it. A handle (not illustrated) may be provided at the front end of the demonstration product locator 30 in order to allow the customer to pull the demonstration product locator 30.

Of course, the mechanism 50 described in relation to FIGS. 5 to 7 is only one example among various possibilities which may be contemplated by the person skilled in the art for linking the movement of the demonstration product locator 30 and the movement of the retail product drawer.

Figure 8:
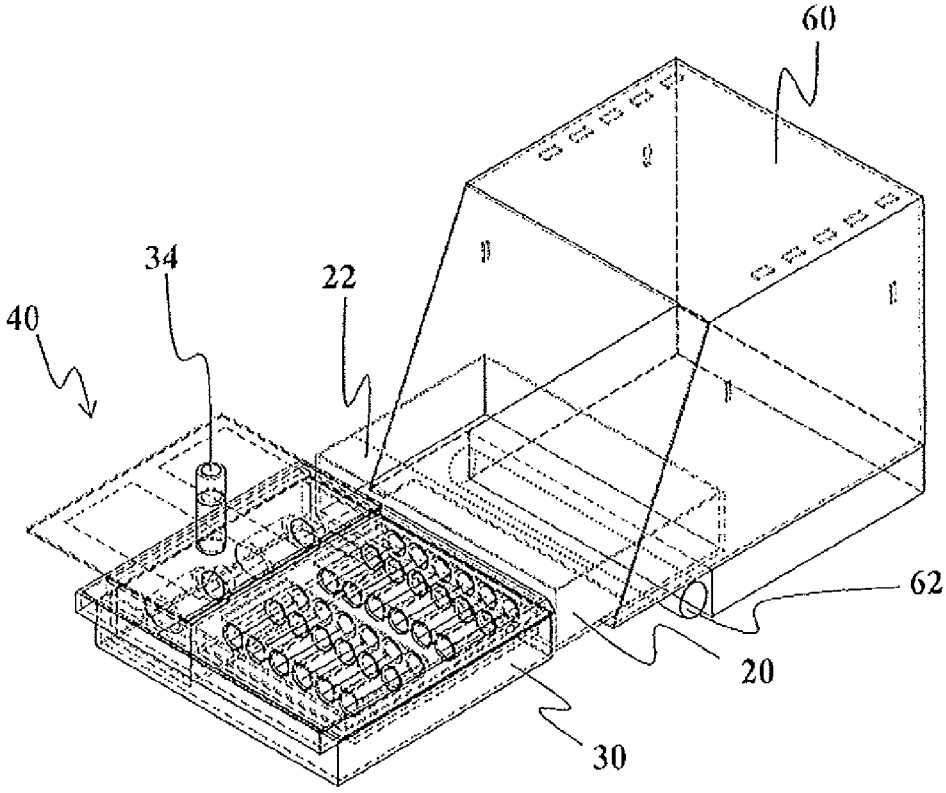
FIG. 8 shows a perspective view of the retail product display system with the retail product drawer in the open position, and with the flap portion in the open position and serving as surface for putting the demonstration products in their position of use.

With reference to FIG. 8, the retail product drawer 20 may comprise a customer communication band 22 preferably in front of the space of the retail product drawer 20 receiving the retail products. Communication with the customer is thereby improved in the horizontal display position of the demonstration product locator 30.

The retail product display system 72 may be arranged for causing the demonstration product locator 30 into the horizontal display position, when the retail product drawer 20 moves towards the open position, at least starting from a position intermediate between the closed and the open position. In FIG. 2, the retail product drawer 20 is shown in the intermediate position. When this intermediate position is reached, the demonstration product locator 30 is caused into the horizontal display position. This feature allows a quick and easy access to the retail product drawer 20 without being obliged to end the movement of the demonstration product locator 30. The demonstration product locator 30 may be caused into the horizontal display position by the effect of gravity and/or by an appropriate mechanism for example a spring (not represented).

The retail product display system 72 may also comprise a lock for maintaining the retail product drawer 20 in the open position. The lock maintains the retail product drawer 20 and/or the demonstration product locator 30 in a stable position. With reference to FIG. 5, the lock comprises a pin 86 on the telescopic tube 66 and a corresponding recess 84 on the telescopic tube 54. When the pin 86 is in the recess 84, the position of the demonstration product locator 30 and of the retail product drawer 20 is stable as represented in FIG. 5. Unlocking is possible for the user by pushing the demonstration product locator in the closing direction of the retail product drawer 20 with a sufficient force to cause the pin 86 to get out of the recess 84, as represented in FIG. 6. Therefore, the recess 84 is provided with an appropriate shape and the tubes 54 and 66 with an appropriate radial tolerance.

With reference to FIG. 1, the demonstration product locator 30 may comprise an interchangeable demonstration product showcase part 36. The demonstration product showcase part 36 is shown alone in FIG. 9. Thus, the demonstration product showcase part 36 can be removed from the remaining part of the demonstration product locator 30 and replaced by another demonstration product showcase part for displaying demonstration products of a different type. This interchangeability of the demonstration product showcase part 36 allows a modularity of the retail product display system 72 as a function of the size and the scale of the demonstration products 34 or in function of aesthetical choices of the retailer or fabricant.

Figure 9:
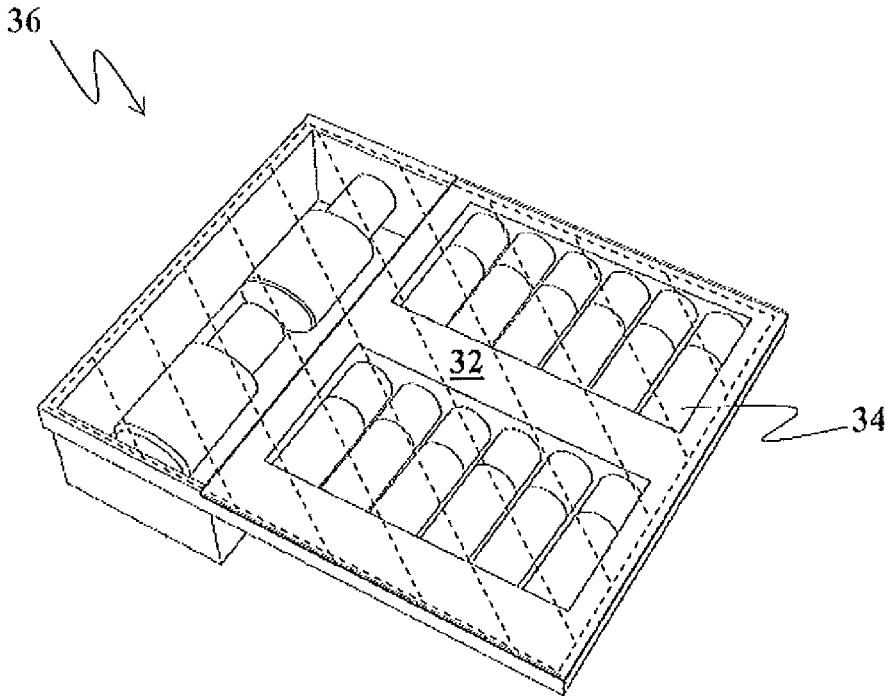
FIG. 9 shows a perspective view of the showcase part of the demonstration product locator.

With reference to FIG. 9, the front face 32 of the interchangeable demonstration product showcase part 36 is preferably flat. Consequently the front face of the demonstration product locator 30 is flat. Therefore, back to FIG. 1 with the demonstration product locator 30 in the horizontal display position, the demonstration product locator 30 forms a bar. This bar allows a user to put the demonstration products in their position of use on the front face. This possibility is illustrated in FIG. 8. Consequently the customer does not need to hold the demonstration products in his hands which as a consequence are available for other purposes e.g. holding a pencil for testing the demonstration product in case of cosmetics. It avoids also the need to provide the user with a separate bar near the retail product display system 72 for putting the demonstration products in their position of use. The position of use of the demonstration products is to be understood as the position in which the user usually puts the products during utilization. The position of use of demonstration products depends of the nature of the product. For example, in the cosmetic field, the demonstration product can be a lipstick, an eye liner, a cream bottle, a lotion bottle, etc. . . . As an example, a cream bottle, during utilization with the cap removed from the bottle, must be placed upright on a horizontal surface in order to avoid the cream from flowing out of the bottle.

Figure 10:
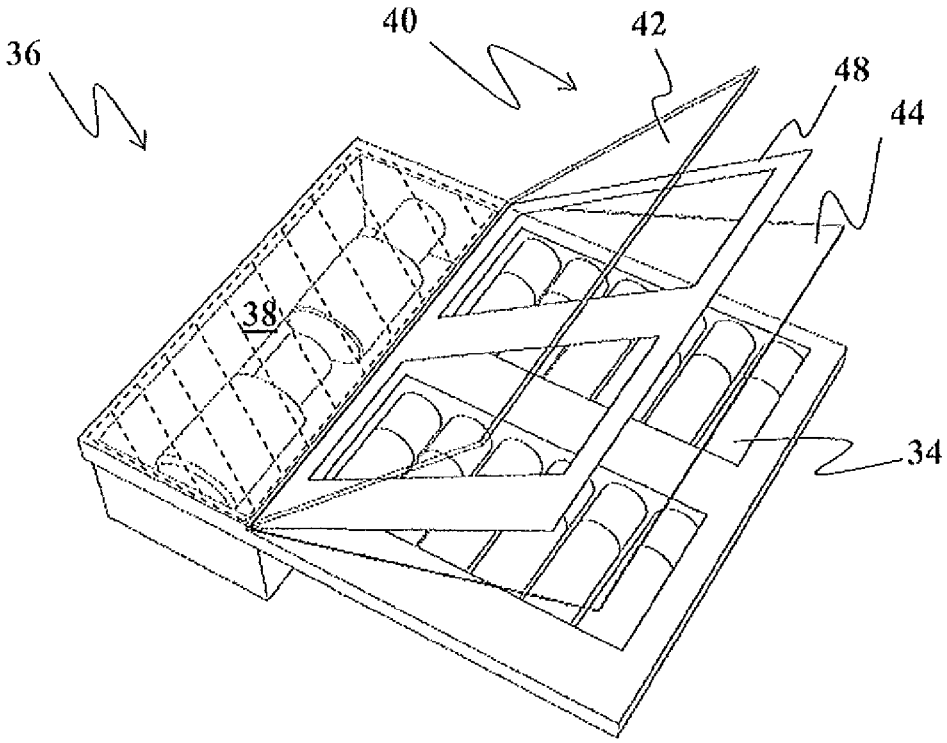
FIG. 10 shows a perspective view of the showcase part of FIG. 7 with the flap portion being opened.

The demonstration product locator 30 may advantageously comprise a flap portion. By comparison of the FIGS. 9 and 10, the interchangeable demonstration product showcase part 36 may comprise the flap portion 40. The flap portion 40 is adapted to be flapped between a closed position in which the flap portion 40 closes the demonstration product locator (represented in FIG. 9) and an open position allowing a customer to access demonstration products 34 in the demonstration product locator. The flap portion 40 is represented in open position in FIG. 8.

In the closed position of the flap portion 40, the demonstration products 34 are protected from dust. In the open position of the flap portion 40, the demonstration products 34 are accessible for the customer wishing to test the demonstration products 34.

The flap portion 40 preferably comprises a front plate 42 and a rear plate 44. The front plate 42 and the rear plate 44 are superposed with each other for receiving a customer communication label 48 between them. At least one of the plate 42, 44 is transparent to allow the customer to see the customer communication label 48. Preferably both of the plates 42, 44 are transparent. Communication space in the demonstration product locator 30 can then be doubled allowing better information of the customer. The customer communication label 48 preferably comprises apertures to allow the customer to see the demonstration products 34 through the customer communication label 48, as illustrated in FIG. 9.

The flap portion 40 is preferably flat thereby forming a bar for allowing a user to put the demonstration products on the flap portion 40 in their position of use when the demonstration product locator is in the horizontal position. The flap portion 40 can form a bar when the flap portion 40 is in one of either the open position or the closed position or in both of these positions.

With reference to FIG. 8, it is shown that the flap flat portion 40 is useful for the user who needs a surface to put the accessible demonstration products 36 in their position of use. Further the flap portion 40 in the closed position can contribute to the flat aspect of the demonstration product locator 30 in order to form a bar.

The demonstration product locator 30 can comprise a non flapping portion on the front face 32. With reference to FIG.

10, the non flapping portion 38 can be delimited as the part of the front face which is not the flap portion 40. The non flapping portion can be a simple show window which is fixed and thus preventing the customer taking out the demonstration products placed underneath. The show window may contribute to the flat aspect of the demonstration product locator 30.

The end of the movement of the demonstration product locator 30 from the horizontal position to the inclined display position can be automatic. The automaticity of at least the end of the movement prevents the demonstration product locator 30 staying in an intermediate position as represented in FIG. 3 which would not be aesthetic, would diminish remote visibility of the demonstration products and fail to prevent dust from entering the box 60 and thus reaching the space for the retail products of the retail product drawer 20.

Therefore, the retail product display system 72 may comprise a positioning device for urging the demonstration product locator 30 into the inclined display position. The urging of the demonstration product locator 30 takes place when the demonstration product locator 30 is moved towards the inclined display position at least once having passed beyond a position intermediate between the horizontal display position and the inclined display position. With reference to FIG. 5, the positioning device comprises a recess 80, a corresponding pin 82 and a pull-back spring 88. The recess 80 is arranged on the telescopic tube 52, the corresponding pin 82 is on the telescopic tube 54. One end of the spring is fixed to the rear of the telescopic tube 54 and the other end of the spring is fixed to the rear of the telescopic tube 52.

When the pin 82 is engaged in the recess 80, the spring 88 is tensioned. When a user pushes the demonstration product locator 30 with a sufficient force (i.e. when the locator is moved towards the inclined display position beyond the intermediate position), the pin 82 is released from the recess 80, as represented in FIG. 6. The spring 88 then urges the demonstration product locator 30 back into the inclined display position as represented in FIG. 7. It should be understood that the intermediate position of the demonstration product locator 30 in FIG. 6 is unstable due to the tension of the spring 88.

The limit forces for releasing the pin 82 from the recess 80, for releasing the pin 86 from the recess 84, and the pulling force of the spring 88 are preferably chosen to allow the movement of the demonstration product locator 30 with respect to the movement of the retail product drawer 20 as represented in the FIGS. 5-7. The force required for releasing the pin 86 from the recess 84 is lower than the force required for releasing the pin 82 from the recess 80. Thus, the retail product drawer 20 is closed before the telescopic tube 52 slides into the telescopic tube 54 and before the demonstration product locator 30 rotates around the hinge 56. Further the pulling force of the spring 88 is lower than the force required for releasing the pin 82 from the recess 80 to avoid involuntary withdrawing of the demonstration product locator 30 in the horizontal display position. However the pulling force of the spring 88 is sufficient to urge the demonstration product locator 30 back into the inclined display position when the locator is in the intermediate position of the FIG. 6.

The retail product display system 72 is preferably designed as a module adapted to be assembled with another module side by side or one above the other. With reference to FIG. 4, holes 64 may be provided in the upper side of the box 60 for the mentioned assembling possibility. The underside of the box 60 is provided with corresponding assembly holes (not illustrated) to allow assembly of the modules one above the other with a threaded rod (not represented). The assembling of the modules can also be side by side, with, for example, assembly holes 64 on the lateral sides of the box 60 in the same manner as the assembly holes 64 on the upper side.

With reference to FIG. 8, the retail product display system 72 may comprise a lamp 62 arranged at a lower part of the box 60 for lighting another retail product display system 72 placed under it. Alternatively, the lamp 62 may also be arranged at a lower part of the retail product drawer 20 or of the demonstration product locator 30. Without this, the outside lighting may not confer sufficient attractiveness to the retail product display system 72 below, especially to the demonstration product locator 30.

Figure 11:
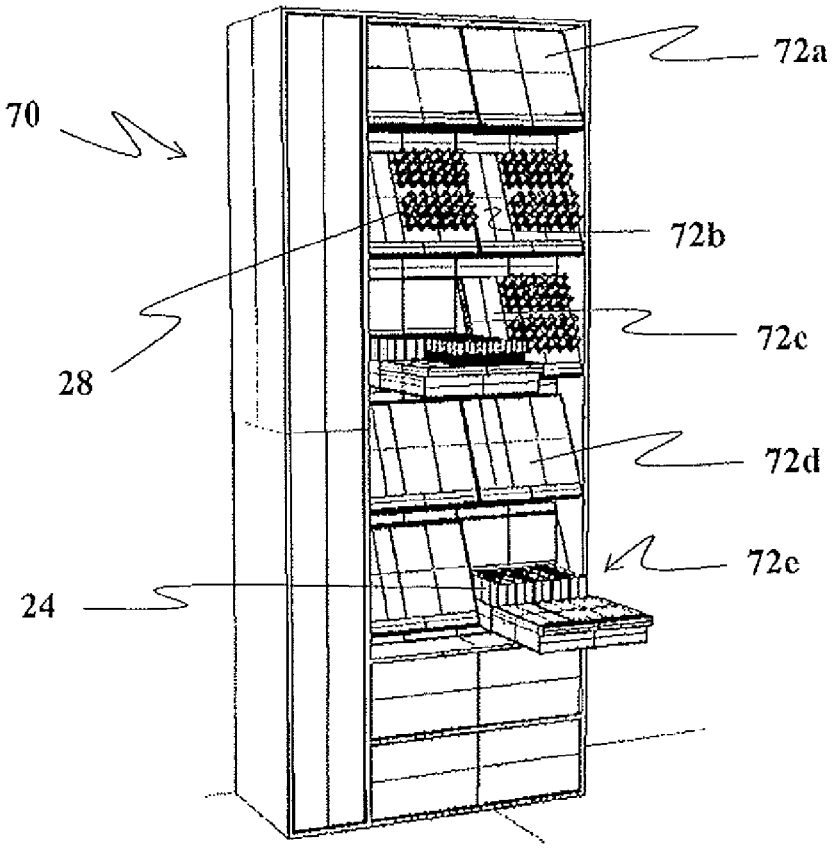
FIG. 11 shows a perspective view of the retail product display stand.

The invention further proposes a retail product display stand comprising at least one retail product display system 72 previously described. The FIG. 11 shows a perspective view of the retail product display stand 70 with 4 retail product display systems 72. Such a stand can be directly put in a retail store as an island display or can be placed in a racking or in aisle end display.

The invention further provides a retail product display stand comprising at least one retail product display system 72 previously described, for selling or promoting retail cosmetic products. The FIG. 11 shows a perspective view of the retail product display stand 70 with five rows 72*a*, 72*b*, 72*c*, 72*d*, 72*e*, each of two retail product display systems. One retail product display system of the rows 72*c* and 72*e* are in the open configuration. These retail product display system then show that their retail product drawer are full of retail products 24. The retail product display system in the rows 72*b* and 72*b* display lipsticks 28. The lipsticks protrude from the front face 32 of the demonstration product locator 30 which is consequently not flat. Such a stand can be directly put in a retail store as an island display or can be placed in a racking or in an aisle end display.

The invention has been described with reference to preferred embodiments. However, many variations are possible within the scope of the invention. For instance, the described retail product display system may be provided without a box 60. In this case; one or several of such devices may be arranged directly between shelves of a stand so as to form a sales cabinet with one or several such retail product drawers 20 with movable demonstration locators 30 at their front, being mentioned that vertical walls of the stand may act as the ramp 68.

Further, attention is drawn to the fact that the demonstration product locator with the flap portion 40 may be implemented on other retail display systems independently from the retail product drawer arrangement and the movable nature of the demonstration product locator at the front of the retail product drawer. As a consequence, the invention also relates to a demonstration product locator comprising a flap portion adapted to be flapped between a closed position in which the flap portion closes the demonstration product locator and an open position allowing a customer to access demonstration products in the demonstration product locator and wherein the flap portion comprises a front plate and a rear plate superposed with each other for receiving a customer communication label between them, at least one of the front plate and rear plates being transparent.

At least one of the plates is transparent to allow the customer to see the customer communication label. Preferably both of the plates are transparent. Communication space in the demonstration product locator may then be doubled allowing better information of the customer. Further the customer communication label is easily removed form the flap portion allowing it to be replaced by a more appropriate customer communication label. Adaptation of the communication content of the customer communication label may vary in conformity with the demonstration products, the customer, or with applicable legislation.

Further, in the closed position of the flap portion, the demonstration products are protected from dust. In the open position of the flap portion, the demonstration products are accessible for the customer wishing to test the demonstration products.

The invention claimed is:

1. A retail product display system (72), comprising:

a retail product drawer (20) slideable between a closed position and an open position;

a demonstration product locator (30) arranged at the front of the retail product drawer (20) and movable between an inclined display position and a horizontal display position; and a mechanism for moving the demonstration product locator (30) to the inclined display position when the retail product drawer (20) is moved to the closed position and for moving the demonstration product locator (30) to the horizontal display position when the retail product drawer (20) is moved to the open position, such that the demonstration product locator (30) in the inclined display position prevents a customer from accessing a content of the retail product drawer (20) in the closed position and such that the demonstration product locator (30) in the horizontal display position allows the customer to access the content of the retail product drawer (20) in the open position.

2. The system according to claim 1, further comprising a box (60) for housing the retail product drawer (20) in the closed position and wherein the demonstration product locator (30) is arranged for closing the box when the retail product drawer (20) is in closed position and the demonstration product locator (30) is in the inclined display position.

3. The system according to claim 2, further comprising a lamp (62) arranged at a lower part of one of the features from the group consisting in the box (60), the demonstration product locator (30) and the retail product drawer (20), for lighting another retail product display system (72) placed under.

4. The system according to claim 3, arranged for causing the demonstration product locator (30) to move into the horizontal display position when the retail product drawer (20) moving towards the open position, reaches a position intermediate between the closed position and the open position.

5. The system according to claim 4, wherein the front face (32) of the demonstration product locator (30) is flat, the front face forming a bar when the demonstration product locator (30) is in the horizontal position for allowing a user to put demonstration products (34) on the front face in their position of use.

6. The system according to claim 5, further comprising a lock (84, 86) for maintaining the retail product drawer (20) in the open position.

7. The system according to claim 6, wherein the demonstration product locator (30) comprises an interchangeable demonstration product showcase part (36).

8. The system according to claim 7, wherein the demonstration product locator (30) comprises a flap portion (40) adapted to be flapped between a closed position in which the flap portion closes the demonstration product locator (30) and an open position allowing a customer to access demonstration products (34) in the demonstration product locator (30) and wherein the flap portion (40) comprises a front plate (42) and a rear plate (44) superposed with each other for receiving a customer communication label (48) between them, at least one of the front plate and rear plate (42, 44) being transparent.

9. The system according to claim 8, wherein the flap portion (40) is flat, the flap portion forming a bar for allowing a user to put demonstration products (34) on the flap portion in their position of use when the demonstration product locator (30) is in the horizontal position and the flap portion (40) is in at least one of the open or the closed position.

10. The system according to claim 9, comprising a positioning device (80, 82, 88) for urging the demonstration product locator (30) into the inclined position at least when the demonstration product locator (30) is moved towards the inclined position beyond a position intermediate between the horizontal position and the inclined position.

11. The system according to claim 10 forming a module, wherein the module is adapted to be assembled with another module side by side or one above the other.

* * * * *